US007100700B2

(12) United States Patent
Davis et al.

(10) Patent No.: US 7,100,700 B2
(45) Date of Patent: Sep. 5, 2006

(54) DOWNHOLE BALL DROPPING APPARATUS

(75) Inventors: John P. Davis, Cypress, TX (US); Gerald D. Lynde, Houston, TX (US)

(73) Assignee: Baker Hughes Incorporated, Hosuton, TX (US)

( * ) Notice: Subject to any disclaimer, the term of this patent is extended or adjusted under 35 U.S.C. 154(b) by 0 days.

(21) Appl. No.: 10/254,104

(22) Filed: Sep. 24, 2002

(65) Prior Publication Data

US 2004/0055753 A1 Mar. 25, 2004

(51) Int. Cl.
*E21B 33/12* (2006.01)

(52) U.S. Cl. ..... 166/386; 166/193; 166/318

(58) Field of Classification Search ..... 166/318, 166/328, 70, 177.4, 379, 67, 95.1, 386, 285, 166/373, 193, 153, 156
See application file for complete search history.

(56) References Cited

U.S. PATENT DOCUMENTS

| | | | | |
|---|---|---|---|---|
| 2,212,087 A | | 8/1940 | Thornhill | |
| 2,635,626 A | * | 4/1953 | Meynig | 137/458 |
| 2,737,244 A | | 3/1956 | Baker et al. | |
| 3,568,768 A | | 3/1971 | Rowell, Jr. | |
| 3,850,194 A | | 11/1974 | Brown | |
| 4,171,019 A | | 10/1979 | Cole | |
| 4,406,335 A | | 9/1983 | Koot | |
| 4,452,322 A | * | 6/1984 | Jurgens | 175/107 |
| 4,577,614 A | * | 3/1986 | Schoeffler | 175/25 |
| 4,589,495 A | * | 5/1986 | Langer et al. | 166/383 |
| 4,887,676 A | * | 12/1989 | Hallez | 175/250 |
| 5,553,672 A | * | 9/1996 | Smith et al. | 166/382 |
| 5,758,726 A | * | 6/1998 | Streich et al. | 166/379 |
| 5,833,002 A | | 11/1998 | Holcombe | |
| 5,960,881 A | | 10/1999 | Allamon et al. | |
| 6,220,360 B1 | | 4/2001 | Connell et al. | |
| 6,390,200 B1 | | 5/2002 | Allamon et al. | |
| 6,715,541 B1 | * | 4/2004 | Pedersen et al. | 166/75.15 |
| 6,776,228 B1 | * | 8/2004 | Pedersen et al. | 166/75.15 |

* cited by examiner

*Primary Examiner*—David Bagnell
*Assistant Examiner*—Shane Bomar
(74) *Attorney, Agent, or Firm*—Steve Rosenblatt

(57) ABSTRACT

A ball release mechanism is mounted near the intended seat. The ball or balls are kept out of the circulating stream. High circulation rates followed by curtailment of circulation places an outlet port in position to allow the ball or balls to be pushed out by a spring. The spring or one of the balls prevents the return of an ejected ball back into the protected pocket. The ball is delivered to the seat without circulation.

34 Claims, 1 Drawing Sheet

DOWNHOLE BALL DROPPING APPARATUS

FIELD OF THE INVENTION

The field of the invention is a ball release device and more particularly a device that is mounted near the hole bottom with the stored ball or balls protected until release after circulation.

BACKGROUND OF THE INVENTION

Most prior ball release devices store the ball in the fluid stream and use circulation to transport it to the seat. Several problems can occur with this design. The ball may not release because the carrier gets clogged with debris from the mud. The carrier can become worn resulting in premature release of the ball. The ball is released during high circulation. It can slam against a seat and create high pressure spikes that can damage other equipment. The high circulation rates around the ball can erode parts of it causing it to not hold pressure even if it lands on the ball seat. Some examples of prior designs that have the ball in the circulating path are U.S. Pat. Nos. 6,390,200; 6,220,360; and 5,960,881. U.S. Pat. No. 4,171,019 shows a cement float shoe with a ball in a side pocket such that it can be displaced against a ball seat if the flow direction reverses. Balls have been used to fix a range of motion of a sleeve valve member, as shown in U.S. Pat. No. 4,406,335.

What the prior devices lacked is addressed by the present invention. The ball is retained near its intended seat near the bottom of the hole. It is retained out of the flowing stream. The ball discharge procedure is such that ball release occurs after circulation is stopped and not during circulation. Once the ball is released it is prevented from reentering its original storage location. These and other benefits of the present invention will be more apparent to those skilled in the art from a review of the description of the preferred embodiment and the claims, which appear below.

SUMMARY OF THE INVENTION

A ball release mechanism is mounted near the intended seat. The ball or balls are kept out of the circulating stream. High circulation rates followed by curtailment of circulation places an outlet port in position to allow the ball or balls to be pushed out by a spring. The spring or one of the balls prevents the return of an ejected ball back into the protected pocket. The ball is delivered to the seat without circulation.

DETAILED DESCRIPTION OF THE DRAWINGS

FIG. 1 is a part section view of the tool during the run in;

DETAILED DESCRIPTION OF THE PREFERRED EMBODIMENT

Figure 1:
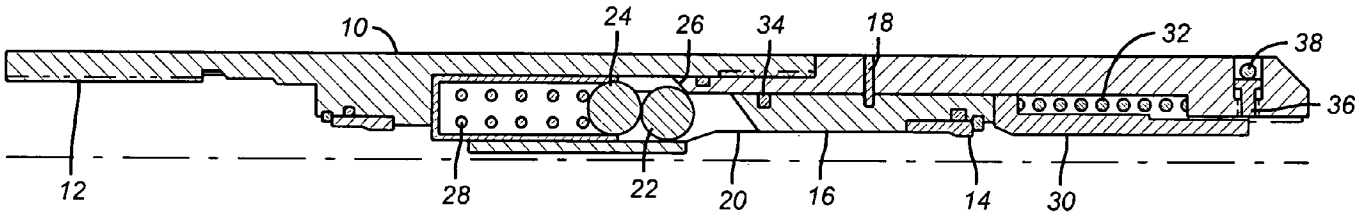
Figure 2:
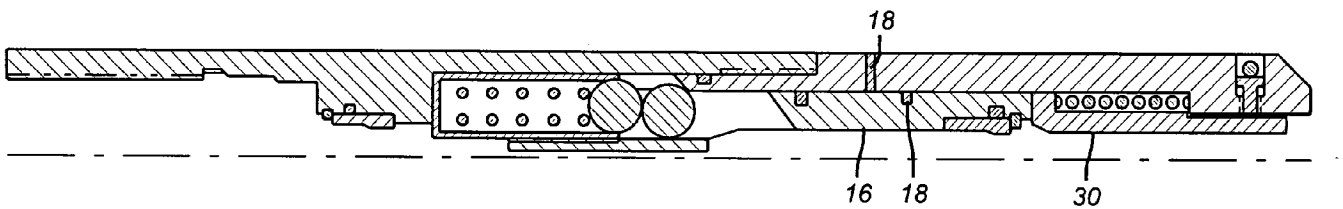
FIG. 2 is the view of FIG. 1 in the circulation position.

Referring to FIG. 1, a housing 10 is connected at thread 12 to a string and downhole equipment (not shown). Housing 10 comprises a primary ball seat 14 preferably mounted on ball carrier 16 or in another housing in fluid communication with housing 10. As illustrated, ball seat 14 provides resistance to circulation to move the ball carrier 16. However, that resistance can be from another constriction on ball carrier 16 with the ball seat in another housing in fluid communication with housing 10. In the preferred embodiment, the balls 22 and 24 drop less than a meter to get to ball seat 14. A shear pin 18 initially holds the ball carrier 16 to the housing 10. In the run in position, an outlet port 20 is so positioned that balls 22 and 24 cannot escape. Balls 22 and 24 are biased toward tapered surface 26 on ball carrier 16 by spring 28. Housing 10 further comprises a sleeve 30 biased by spring 32 toward ball carrier 16. A seal 34 seals between ball carrier 16 and housing 10. For run in, sleeve 30 holds in detent pin 36 against the bias of spring 38.

Figure 3:
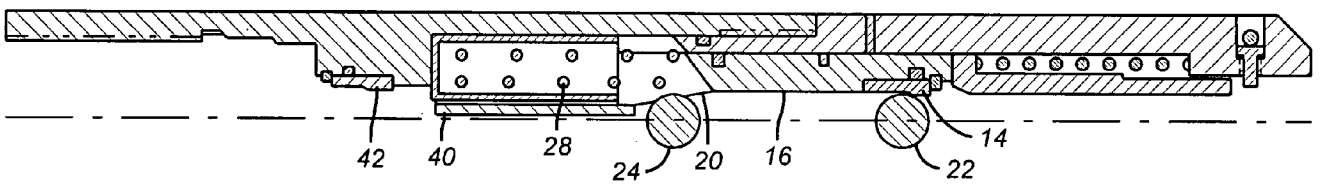
FIG. 3 is the view of FIG. 2 with the ball released after circulation has ceased.

The operation of the tool will now be reviewed. Circulation is started through housing 10. As a result a net force is applied to ball carrier 16 shifting it down against sleeve 30 and compressing spring 32. While the restriction from ball seat 14 that causes ball carrier 16 to be displaced by circulation is shown at the lower end of the ball carrier 16, the actual restriction that causes the ball carrier 16 to shift can be located elsewhere on ball carrier 16, while the ball seat 14 can be in any other location below balls 22 and 24. The shear pin 18 is broken by movement of ball carrier 16. Balls 22 and 24 are held retained by tapered surface 26. Circulation is then stopped. Spring 32 displaces sleeve 30 to position outlet port 20 in alignment to let balls 22 and 24 escape with a push from spring 28. Ball 22 lands on primary ball seat 14, which is less than a meter away, while ball 24 is optional. Ball 24 keeps ball 22 near seat 14 because the upper end 40 of ball carrier 16 as well as spring 28 in its extended position help to maintain ball 24 in the position shown in FIG. 3. Spring 38 has pushed out detent pin 36 to prevent needless cycling of ball carrier 16 at a later time when circulation is resumed for other purposes.

A secondary ball seat 42 is provided to accept a ball dropped from the surface in a known manner, in the event ball 22 fails to seal or hold enough pressure against primary ball seat 14.

Those skilled in the art will appreciate that the present invention has many unique features. The ball or balls are stored out of the flowing path of mud and are less likely to be eroded or deformed by circulation. The balls are not released during circulation. Pressure spikes are eliminated as the balls are released from a location very close to the seat after circulation has stopped. There is no need to wait a long time for the ball to seat from the time of release, because the release point is so close to the ultimate seat location. This tool can be run below tools that would not be able to pass a ball. The tool is of particular advantage on a horizontal run. In the past, a ball dropped from the surface could land in many places short of the desired seat. This is particularly the case when running long lengths of screen to be expanded in a horizontal run. In the present invention, seating occurs almost immediately after release due to the close proximity between the release point and the seat. In the unlikely event of a failure of the tool, a secondary seat is provided to allow a backup ball to be dropped in the known manner. Alternatively, a plurality of balls of different sizes can be stored in the tool. Bigger balls can reuse Ball seat 14 after an initial ball expands the seat a given amount in a known manner. Alternatively, smaller balls can be subsequently released that will pass through seat 14 after the first ball is blown through it and land on another seat further down. While the preferred embodiment has been shown with two balls, one ball or more balls can be used. They can be released all at once or one at a time such as by using a ratchet device actuated by cycling the circulation on and off. To do this the detent pin 36 could be eliminated. No rotation is required to operate the tool making it useful in deviated wells.

The foregoing disclosure and description of the invention are illustrative and explanatory thereof, and various changes in the size, shape and materials, as well as in the details of the illustrated construction, may be made without departing from the spirit of the invention.

We claim:

1. A ball dropping apparatus, comprising:

a housing having an uphole and a downhole end and a passage through it;

at least one obstructing member mounted in said housing;

said obstructing member selectively movable from an initial position where it is located outside of said passage downwardly toward said downhole end to an obstructing position in said passage where it will prevent flow toward said downhole end by obstructing said passage;

said obstructing member in said first position is disposed in a side compartment selectively accessible to said passage;

a selectively movable carrier to hold said obstructing member in said side compartment, in a first position, and to allow release of said obstructing member from said side compartment, when placed in a second position;

said obstructing member is selectively released into said passage by virtue of flow through said passage;

said obstructing member remaining in said initial position until movement of said carrier in opposed directions has occurred.

2. The apparatus of claim 1, further comprising:

a seat in one of said passage and a housing connected to the ball dropping apparatus, said obstructing member allowing pressure buildup at said uphole end of said housing when it is located on said seat.

3. The apparatus of claim 2, wherein:

said obstructing member enters said passage within 1 meter of said seat.

4. The apparatus of claim 3, wherein:

said obstructing member comprises a ball; and said housing comprises a backup seat for use if said ball fails to hold pressure against said seat.

5. The apparatus of claim 1 wherein:

said carrier further comprises a flow passage therethrough and wherein a primary seat is mounted in one of said flow passage and a housing connected to the ball dropping apparatus to receive said obstructing member.

6. The apparatus of claim 1 wherein:

said carrier is biased in a direction where said obstructing member will be allowed to exit said side compartment.

7. The apparatus of claim 1, wherein:

said obstructing member is biased toward said passage from within said side compartment.

8. The apparatus of claim 1, further comprising:

a spring in said side compartment, said spring preventing reentry of said obstructing member into said side compartment.

9. The apparatus of claim 1, wherein:

said at least one obstructing member comprises a plurality of balls; and a second of said balls prevents a first of said balls, that exits said side compartment, from reentering.

10. A ball dropping apparatus, comprising:

a housing having an uphole and a downhole end and a passage through it;

at least one obstructing member mounted in said housing;

said obstructing member selectively movable from an initial position where it is located outside of said passage downwardly toward said downhole end to an obstructing position in said passage where it will prevent flow toward said downhole end;

said obstructing member is selectively released into said passage by virtue of flow through said passage;

said obstructing member is selectively released into said passage only by the onset and subsequent cessation of flow through said passage.

11. A ball dropping apparatus, comprising:

a housing having an uphole and a downhole end and a passage through it;

at least one obstructing member mounted in said housing;

said obstructing member selectively movable from an initial position where it is located outside of said passage downwardly toward said downhole end to an obstructing position in said passage where it will prevent flow toward said downhole end;

said obstructing member in said initial position is disposed in a side compartment selectively accessible to said passage;

a selectively movable carrier to hold said obstructing member in said side compartment, in a first position, and to allow release of said obstructing member from said side compartment, when placed in a second position;

said carrier is biased in a direction where said obstructing member will be allowed to exit said side compartment;

said carrier is initially secured to said housing with said bias overcome.

12. A ball dropping apparatus, comprising:

a housing having an uphole and a downhole end and a passage through it;

at least one obstructing member mounted in said housing;

said obstructing member selectively movable from an initial position where it is located outside of said passage to an obstructing position in said passage;

said obstructing member in said initial position is disposed in a side compartment selectively accessible to said passage;

a selectively movable carrier to hold said obstructing member in said side compartment, in a first position, and to allow release of said obstructing member from said side compartment, when placed in a second position;

said carrier is biased in a direction where said obstructing member will be allowed to exit said side compartment;

said carrier is initially secured to said housing with said bias overcome;

said carrier is mounted in said passage;

said initial securing of said carrier is broken with flow through said flow passage.

13. The apparatus of claim 12, wherein:

said obstructing member remains trapped in said side compartment while flow through said passage overcomes said bias on said carrier.

14. The apparatus of claim 13, wherein:

said obstructing member is released from said side compartment when said bias on said carrier shifts it, upon cessation of flow through said passage.

15. The apparatus of claim 14, wherein:

said carrier comprises an outlet opening that shifts into alignment with said obstructing member as a result of its movement under said bias.

16. The apparatus of claim 14, wherein:

said carrier is locked into position after being shifted by said bias.

17. The apparatus of claim 16, wherein:

said bias on said carrier comprises a spring protected from said passage by a sleeve, said sleeve initially covers a detent in said housing, whereupon when said sleeve is biased against said carrier to move it in a first direction, said detent emerges from said housing into said passage to prevent significant movement of said carrier in a second direction opposite said first direction.

18. A method for obstructing a passage downhole, comprising:

mounting at least one obstructing member in a housing;

providing an uphole and a downhole end and a passage through said housing;

disposing said obstructing member in a first position in a side compartment selectively accessible to said passage;

providing a selectively movable carrier to hold said obstructing member in said side compartment, in said first position, and to allow release of said obstructing member from said side compartment and into said passage, to place said obstructing member in a second position;

placing said housing downhole;

moving said obstructing member from said first position to said second position to obstruct said passage only after said carrier moves in opposed directions in response to flow through said passage.

19. The method of claim 18, comprising:

providing a seat in one of said passage and a housing connected;

building pressure at said uphole end of said housing when said obstructing member is located on said seat.

20. The method of claim 19, comprising:

allowing said obstructing member to enter said passage within 1 meter of said seat.

21. The method of claim 20, comprising:

providing a ball as said obstructing member; and providing a backup seat in said housing for use if said ball fails to hold pressure against said seat.

22. The method of claim 18, comprising:

providing a flow passage through said carrier;

mounting a primary seat in one of said flow passage and a housing connected to it, to receive said obstructing member.

23. The method of claim 18, comprising:

biasing said carrier in a direction where said obstructing member will be allowed to exit said side compartment.

24. The method of claim 18, comprising:

biasing said obstructing member toward said passage from within said side compartment.

25. The method of claim 18, comprising:

providing a spring in said side compartment;

preventing reentry of said obstructing member into said side compartment with said spring.

26. The method of claim 18, comprising:

providing a plurality of balls as said at least one obstructing member; and using a second of said balls to prevent a first of said balls that exits said side compartment, from reentering.

27. A method for obstructing a passage downhole, comprising:

mounting at least one obstructing member in a housing;

providing an uphole and a downhole end and a passage through said housing;

placing said housing downhole, moving said obstructing member from an initial position where it is located outside of said passage to an obstructing position in said passage;

selectively releasing said obstructing member by virtue of flow through said passage;

selectively releasing said obstructing member only by the onset and subsequent cessation of flow through said passage.

28. A method for obstructing a passage downhole, comprising:

mounting at least one obstructing member in a housing;

providing an uphole and a downhole end and a passage through said housing;

placing said housing downhole, moving said obstructing member from an initial position where it is located outside of said passage to an obstructing position in said passage;

disposing said obstructing member in said initial position in a side compartment selectively accessible to said passage;

providing a selectively movable carrier to hold said obstructing member in said side compartment, in a first position, and to allow release of said obstructing member from said side compartment, when placed in a second position;

biasing said carrier in a direction where said obstructing member will be allowed to exit said side compartment;

initially securing said carrier to said housing with said bias overcome.

29. A method for obstructing a passage downhole, comprising:

mounting at least one obstructing member in a housing;

providing an uphole and a downhole end and a passage through said housing;

placing said housing downhole, moving said obstructing member from an initial position where it is located outside of said passage to an obstructing position in said passage;

disposing said obstructing member in said initial position in a side compartment selectively accessible to said passage;

providing a selectively movable carrier to hold said obstructing member in said side compartment, in a first position, and to allow release of said obstructing member from said side compartment, when placed in a second position;

biasing said carrier in a direction where said obstructing member will be allowed to exit said side compartment;

initially securing said carrier to said housing with said bias overcome;

mounting said carrier in said passage;

breaking said initial securing of said carrier with flow through said flow passage.

30. The method of claim 29, comprising:

trapping said obstructing member in said side compartment while flow through said passage overcomes said bias on said carrier.

31. The method of claim 30 comprising:

releasing said obstructing member from said side compartment when said bias on said carrier shifts it, upon cessation of flow through said passage.

32. The method of claim 31, comprising:

providing an outlet opening on said carrier that shifts into alignment with said obstructing member as a result of its movement under said bias.

33. The method of claim 31,comprising:

locking said carrier into position after being shifted by said bias.

34. The method of claim 33, comprising:

biasing said carrier with a spring protected from said passage by a sleeve;

initially covering a detent in said housing with said sleeve;

extending said detent from said housing into said passage to prevent significant movement of said carrier in a second direction opposite said first direction when said sleeve is biased against said carrier to move it in a first direction.

* * * * *